US006600397B2

(12) United States Patent
Bassi

(10) Patent No.: US 6,600,397 B2
(45) Date of Patent: Jul. 29, 2003

(54) DEVICE FOR CONTROLLING AN ELECTRIC APPLIANCE, IN PARTICULAR A DRIER OR OTHER ELECTRIC HOUSEHOLD APPLIANCE

(75) Inventor: Alberto Bassi, Torino (IT)

(73) Assignee: ITW Industrial Components S.R.L., Milan (IT)

( * ) Notice: Subject to any disclaimer, the term of this patent is extended or adjusted under 35 U.S.C. 154(b) by 79 days.

(21) Appl. No.: 09/800,957

(22) Filed: Mar. 8, 2001

(65) Prior Publication Data

US 2001/0035806 A1 Nov. 1, 2001

(30) Foreign Application Priority Data

Mar. 8, 2000 (IT) ..... MI2000A0454

(51) Int. Cl.[7] ..... H01H 9/00; H01H 13/04

(52) U.S. Cl. ..... 335/205; 200/333; 200/61.62

(58) Field of Search ..... 192/136; 200/61.62, 200/61.7, 333; 335/128, 2

(56) References Cited

U.S. PATENT DOCUMENTS

| | | | | |
|---|---|---|---|---|
| 3,440,373 A | | 4/1969 | Blewitt | |
| 3,609,265 A | * | 9/1971 | Garbe et al. | 200/61 |
| 3,691,645 A | * | 9/1972 | Nethersell | 34/58 |
| 3,803,725 A | * | 4/1974 | Takeyama | 34/595 |
| 4,511,771 A | * | 4/1985 | Rossell | 200/61.73 |
| 4,717,794 A | * | 1/1988 | Paul et al. | 200/50.1 |
| 5,153,395 A | * | 10/1992 | Schantz et al. | 200/61.62 |
| 5,690,206 A | | 11/1997 | Carroll et al. | |
| 5,728,985 A | | 3/1998 | Hapke et al. | |
| 6,313,445 B1 | * | 11/2001 | Garneau et al. | 219/414 |

FOREIGN PATENT DOCUMENTS

| | | |
|---|---|---|
| DE | 38 01 648 | 7/1989 |
| EP | 0 859 079 | 8/1998 |

* cited by examiner

*Primary Examiner*—Lincoln Donovan
*Assistant Examiner*—Bernard Rosas
(74) *Attorney, Agent, or Firm*—Lowe Hauptman Gilman & Berner LLP

(57) ABSTRACT

A device for controlling an electric appliance having a door, a main power circuit, and a switch for automatically shutting off the main circuit when the door is opened the switch is a reactivatable magnetic switch, which selectively assumes a closed position and an open position respectively closing and opening the main circuit. The magnetic switch is powered by an activating circuit, which is cut off when the door is opened and a movable part of a hinge supporting the door is rotated. When the activating circuit is cut off, the magnetic switch is moved into the open position by the actin of a spring which keeps the magnetic switch in the open position even when the activating circuit is closed again. The user, after closing the door, must reactivate the magnetic switch by pressing a push-button to move the magnetic switch into the closed position.

21 Claims, 3 Drawing Sheets

DEVICE FOR CONTROLLING AN ELECTRIC APPLIANCE, IN PARTICULAR A DRIER OR OTHER ELECTRIC HOUSEHOLD APPLIANCE

The present invention relates to a device for controlling an electric appliance featuring a door, in particular a drier or other electric household appliance.

BACKGROUND OF THE INVENTION

As is known, many commonly used electric household appliances must be provided with various safety devices to prevent improper use. For example, clothes-driers, which typically feature a rotary drum, must be prevented from being opened while the machine is on, to prevent the clothes from being expelled and, more importantly, injury to the user by the moving parts of the machine.

Driers are known, for example, in which the circuit powering the machine motor is cut off when the door is opened, thus stopping the machine, and is reconnected, and the machine turned back on, when the door is closed. For which purpose, a switch is fitted directly to the door, e.g. to the handle, and opening of the door separates two contacts, which cut off supply to the machine. Locating the switch on the door, however, not only poses problems in terms of bulk and assembly, but is also not altogether reliable from the safety standpoint: in addition to the possibility of sparks being generated in a user-hazardous position between opening and closing the door, it would be safer for the machine to be turned back on manually by the user as opposed to automatically when the door is closed.

Mechanically operated switches are also known wherein, once the switch is set to the open position, a mechanical lock intervenes to prevent it from being inadvertently closed by other than direct operation by the user. Applying such a switch to appliances of the above type, however, fails to provide an all-round solution to the safety problems referred to.

SUMMARY OF THE INVENTION

It is therefore an object of the present invention to provide a control device which, while cheap and easy to produce and assemble, is completely functional, effective and reliable, and, in particular, ensures completely safe operation of the appliance to which it is fitted.

According to the present invention, there is provided a device for controlling an electric appliance, in particular a drier or other electric household appliance featuring a door, the device comprising a main circuit; means for cutting off said main circuit; and a hinge supporting a user-operated movable member of said appliance; the device being characterized in that said means for cutting off the main circuit comprise contact means associated with said hinge and for selectively opening and closing said main circuit when said hinge is rotated; said contact means comprising a fixed contact connected to said appliance, a movable contact carried by a movable portion of said hinge, and insulating means for electrically insulating said fixed contact and said movable contact with respect to said appliance and said hinge.

The invention also extends to an electric appliance—in particular a drier or other electric household appliance featuring a door—comprising the control device described briefly above.

The device according to the invention is cheap and easy to produce and assemble, and is completely functional and effective in preventing improper use of the appliance to which it is fitted. The appliance, in fact, is automatically and effectively turned off when the door is opened, and turning the appliance back on calls not only for closing the door but also for direct manual intervention by the user reactivating a magnetic switch in opposition to elastic means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
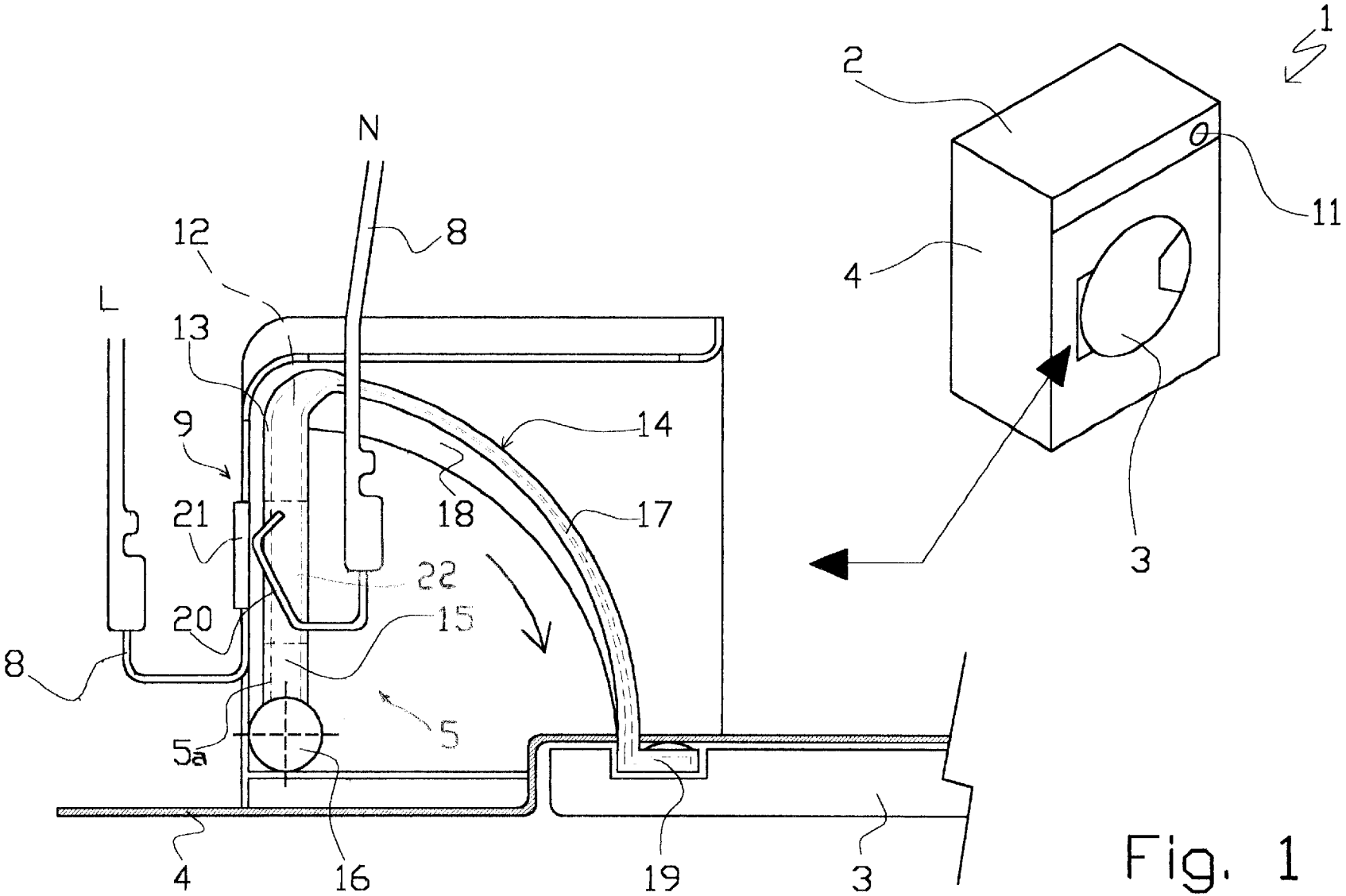
FIG. 1 shows schematically a drier featuring a control device in accordance with the invention, and a larger-scale, schematic detail of the device.

Number 1 in the accompanying drawings indicates as a whole a device for controlling an electric appliance 2—in particular, a substantially known clothes-drier—featuring a user-operated movable member 3 defined, in the example shown, by a door hinged to the casing 4 of appliance 2 by at least one supporting hinge 5.

According to the invention, in addition to hinge 5 supporting door 3, device 1 comprises a main circuit 6 powering appliance 2; a reactivatable magnetic switch 7 for automatically cutting off main circuit 6 when door 3 is opened; an activating circuit 8 for activating magnetic switch 7; contact means 9 associated with hinge 5 and for selectively closing/cutting off activating circuit 8; actuating means 10, in particular elastic means, for opening magnetic switch 7 when activating circuit 8 is cut off, and for keeping magnetic switch 7 open even when activating circuit 8 is closed; and manual control means 11 for reactivating magnetic switch 7 in opposition to elastic means 10.

With particular reference to FIG. 1 hinge 5 comprises a movable portion 5*a* made of plastic insulating material or (as shown by the dash line in FIG. 1) defined by a metal core 12 coated with at least one layer 13 of plastic insulating material so as to comprise an electrically insulating outer surface 14. In the FIG. 1, example, movable portion 5*a* comprises a base portion 15 having, at a first end, known rotary connecting means 16 (not shown in detail for the sake of simplicity) for connection to casing 4; and a curved arm 17, which projects from a second end of base portion 15, curves towards the first end, possibly comprises a reinforcing rib 18, and has a free end 19 connected integrally to door 3 in known manner. Base portion 15 is fitted integrally with a movable contact 20, which is a terminal of branch N of activating circuit 8 and is defined by contoured metal plate projecting from base portion 15, or the opposite side to curved arm 17, so as to contact, when door 3 is closed (as shown in FIG. 1), corresponding fixed contact 21 defined by a terminal of branch L of activating circuit 8 fixed to casing 4 (see also FIGS. 2 and 3). Metal plate 20 is movable with base portion 15 so that, when hinge 5 is rotated by opening door 3 (in the direction of the arrow in FIG. 1), metal plate 20 is detached from terminal 21 to cut off activating circuit 8. In one variation (shown by the dash line in FIG. 1), movable portion 5*a* of hinge 5 is made of metal and has an insert 22 made of electrically insulating material and connected to movable portion 5*a* in known manner. In which case, metal plate 20 extends from insert 22 which insulates metal plate 20 electrically from the rest of hinge.

Figure 2:
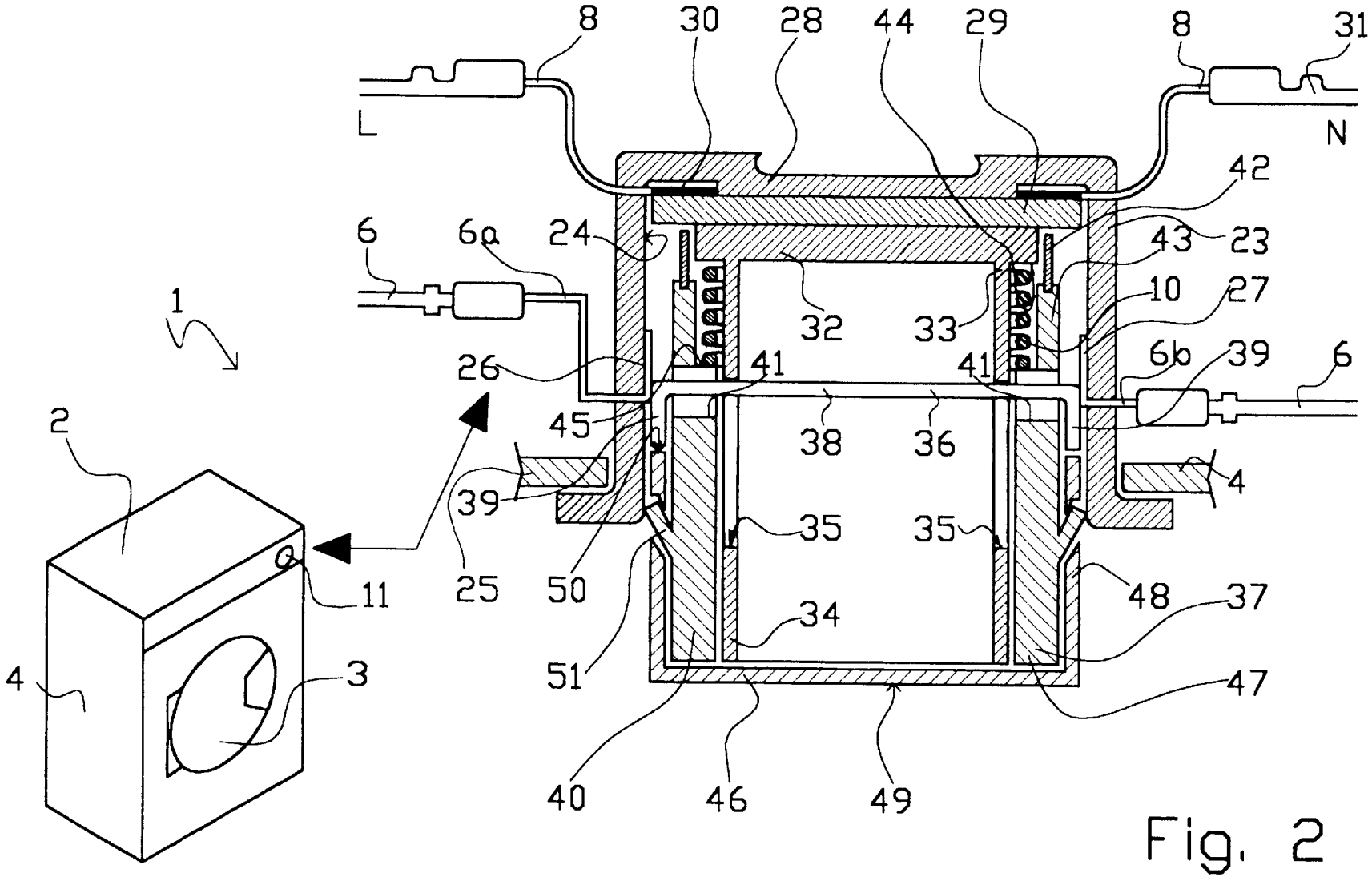
FIG. 2 shows the FIG. 1 drier and a larger-scale, schematic detail of a further component of the device according to the invention in a first operating condition.
Figure 3:
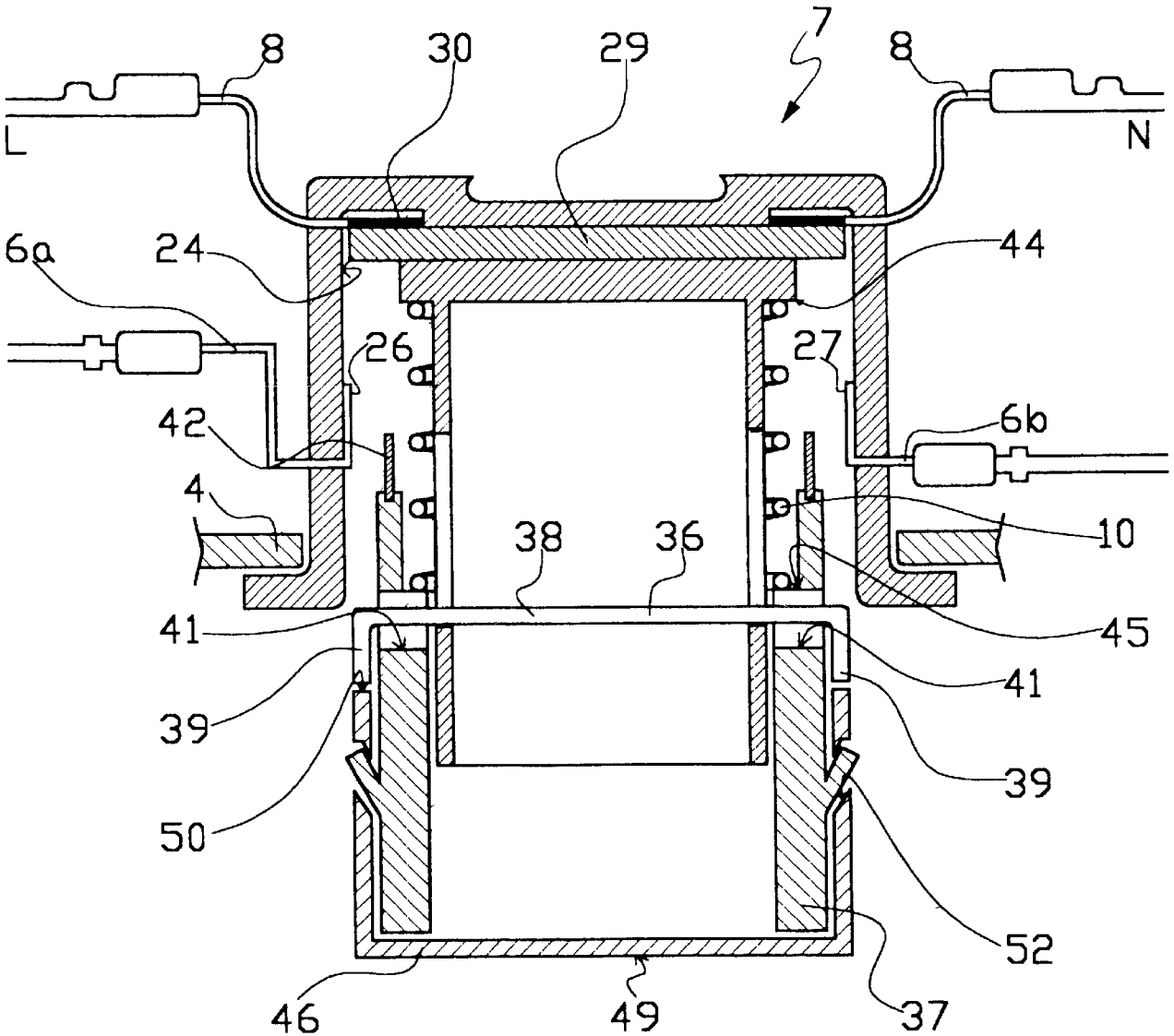
FIG. 3 shows the FIG. 2 component in a second operating condition.

With particular reference to FIGS. 2 and 3, main circuit 6 connects a supply line in known manner to a motor (not shown) of appliance 2 by means of respective branches 6*a*, 6*b*, between which is inserted magnetic switch 7. Magnetic switch 7 (best seen in FIG. 3) comprises an enclosure 23 having a seat 24, e.g. of cylindrical shape; enclosure 23 is inserted inside an opening in a front wall 25 of casing 4; seat 24 houses two facing, diametrically opposite contacts 26, 27 connected to branches 6*a*, 6*b* respectively; and a bottom wall 28 of seat 24 is fitted with an electromagnet 29 defined, for example, by a disk made of appropriate material and supplied by activating circuit 8 by means of an annular contact 30, which is interposed between bottom wall 28 and electromagnet 29 and is in turn connected electrically to metal plate 20 (FIG. 1), and to a further contact (neutral) 31 of branch N of activating circuit 8 (also shown in FIG. 3).

Magnetic switch 7 may selectively assume a closed position (FIG. 2) and an open position (FIG. 3) respectively closing and opening main circuit 6. More specifically, magnetic switch 7 further comprises a connector 36 carried by a member 37, which is movable between a first operating position (FIG. 2) wherein connector 36 electrically connects contacts 26, 27 and, therefore, branches 6*a*, 6*b* of main circuit 6, and a second operating position (FIG. 3) wherein connector 36 cuts off main circuit 6 and separates branches 6*a*, 6*b*.

In the non-limiting example shown, connector 36 is bridge-shaped, and comprises a central plate 38 and two end portions 39 bent at 90° to the central plate; and member 37 comprises a tubular body 40 mounted to slide along an outer lateral surface of guide member 32, and having, in its own lateral wall, two diametrically opposite through openings 41 defining a seat for the insertion of connector 36 (and therefore of a height at least equal to the height of connector 36). Connector 36 extends transversely through tubular body 40, and projects from openings 41 beyond the lateral wall of tubular body 40 towards contacts 26, 27. Member 37 also comprises an armature 42 defined, for example, by a metal ring projecting axially from a longitudinal end 43 of member 37 facing electromagnet 29; and electromagnet 29 exerts on armature 42, when activating circuit 8 is closed, a predetermined electromagnetic attraction which ceases when activating circuit 8 is cut off.

In the non-limiting example shown, elastic means 10 are defined by a helical spring wound about guide member 32 and interposed axially between respective shoulders 44, 45 of guide member 32 and member 37.

Manual control means 11 comprise a push-button 46 connected mechanically to a longitudinal end 47 of member 37 opposite longitudinal end 43. For example, push-button 46 is defined by a hollow enclosure 48 having a pressure surface 49 and an annular edge 50 at respective opposite ends, and which clicks on to tubular body 40 by means of flexible tabs 51 and respective connecting seats 52 (FIG. 3). Pressure surface 49 is accessible to the user through the mouth of seat 24, so that push-button 46 can be pressed to push member 37 inside seat 24 in opposition to spring 10.

Spring 10 exerts on member 37 a predetermined force, which is only overcome by the electromagnetic attraction exerted by electromagnet 29 on armature 42 when the distance between electromagnet 29 and armature 42 is less than a predetermined minimum.

At the assembly stage, magnetic switch 7 is advantageously preassembled and then inserted inside the relative opening in casing 4: electromagnet 29 with annular contact 30, guide member 32 with spring 10, contacts 26, 27, and member 37 with push-button 46 are fitted inside enclosure 23 inside seat 24; connector 36 is inserted inside openings 41 when these are aligned with openings 35: end portions 39 of connector 36 rest on annular edge 50 of hollow enclosure 48 beneath openings 41, thus preventing transverse withdrawal of connector 36; and member 37 is secured axially to guide member 32 by connector 36 engaging openings 35, which nevertheless enable member 37 to slide axially by an amount equal to the height of openings 35. The preassembled magnetic switch 7 is then fitted to appliance 2 in known manner, and the various electrical contacts connected.

Once assembled and fitted to appliance 2, device 1 operates as follows. When appliance 2 is on, door 3 is closed and hinge 5 ensures contact between metal plate 20 and terminal 21 (FIG. 1), so that activating circuit 8 is closed and supplies electromagnet 29; magnetic switch 7 is in the closed position 7*a* (FIG. 2) with member 37 in the first operating position wherein connector 36 electrically connects branches 6*a*, 6*b* of main circuit 6 by end portions 39 of connector 36 touching contacts 26, 27; and armature 42 is a small distance from (or contacting) electromagnet 29, which distance is less that the predetermined minimum distance at which the electromagnetic attraction exerted by electromagnet 29 on armature 42 is greater than the force of spring 10, so that magnetic switch 7 remains in the closed position 7*a* in opposition to the consequently compressed spring 10.

When the user opens door 3, rotation of movable portion 5*a* of hinge 5 (in the direction of the arrow in FIG. 1) breaks the contact between metal plate 20 and terminal 21, thus opening activating circuit 8; power is therefore cut off to electromagnet 29, which no longer exerts any attraction on armature 42; and the force of spring 10 causes member 37 to slide into the second operating position (FIG. 3) wherein connector 36 cuts off main circuit 6 and separates branches 6*a*, 6*b*, so that magnetic switch 7 is therefore in the open position 7*b* cutting off main circuit 6 and so turning off appliance 2.

In the above condition, the distance between armature 42 and electromagnet 29 is greater than the predetermined minimum distance at which the electromagnetic attraction exerted by electromagnet 29 on armature 42 is greater than the force of spring 10, so that, when door 3 is closed, thus closing contact means 9 and restoring power to electromagnet 29, the attraction exerted by electromagnet 29 on armature 42 is not enough to restore magnetic switch 7 to the closed position 7*a* in opposition to spring 10; and, to turn appliance 2 back on calls for direct manual intervention by the user, who, after closing door 3, must reactivate magnetic witch 7 by pressing push-button 46, in opposition to spring 10, to restore member 37 to the first operating position wherein the distance between armature 42 and electromagnet 29 is such that the electromagnetic attraction exerted by electromagnet 29 is greater than the force of spring 10. Now main circuit 6 is restored and the appliance turns back on.

Clearly, changes may be made to the device as described and illustrated herein without, however, departing from the scope of the present invention.

What is claimed is:

1. A device (1) for controlling an electric appliance (2), the device comprising a main circuit (6); means (7, 9) for cutting off said main circuit (6); and a hinge (5) supporting a user-operated movable member (3) of said appliance;

wherein said means for cutting off the main circuit comprise contact means (9) associated with said hinge (5) and for selectively opening and closing said main circuit (6) when said hinge (5) is rotated; said contact means (9) comprising a fixed contact (21) connected to said appliance, a movable contact (20) carried by a movable portion (5*a*) of said hinge (5), and insulating means (14; 22) for electrically insulating said fixed contact and said movable contact (21, 20) with respect to said appliance and said hinge (5).

2. A device as claimed in claim 1, wherein said movable member is a door (3) of said appliance (2); and said movable contact is defined by a contoured metal plate (20) carried by said movable portion (5*a*) of the hinge and which contacts said fixed contact (21) when said door (3) is closed, and which is detached from said fixed contact (21) when said movable portion (5*a*) is rotated by opening said door (3).

3. A device as claimed in claim 2, wherein said insulating means comprise an insulating insert (22) made of electrically insulating material, carried by said movable portion (5*a*) of the hinge, and from which said metal plate (20) extends.

4. A device as claimed in claim 2, wherein said movable portion (5*a*) of the hinge has an electrically insulating outer surface (14); said movable portion being made of plastic insulating material or comprising a metal core (12) coated with plastic insulating material.

5. A device as claimed in claim 2, wherein said movable portion (5*a*) of the hinge comprises a base portion (15) having, at a first end, rotary connecting means (16) for connection to a casing (4) of said appliance (2); and a curved arm (17) projecting laterally from a second end of said base portion (15) and curving towards said first end; said metal plate (20) being carried by said base portion (15) and projecting from said base portion (15) on the opposite side to said curved arm (17).

6. A device as claimed in claim 1, wherein said means for cutting off said main circuit (6) further comprise a reactivatable magnetic switch (7) which selectively assumes a closed position and an open position respectively closing and opening said main circuit (6); an activating circuit (8) for activating said magnetic switch (7); actuating means (10) for moving said magnetic switch (7) into the open position when said activating circuit (8) is cut off, and for keeping said magnetic switch (7) in the open position (7*b*) eve when said activating circuit (8) is again closed; and manual control means (11) for reactivating and restoring said magnetic switch (7) from the open position to the closed position in opposition to said actuating means (10); said contact means (9) selectively closing/cutting off said activating circuit (8).

7. A device as claimed in claim 6, wherein said magnetic switch (7) comprises an electric connector (36) carried by a member (37) movable between<first operating position wherein said connector (36; electrically connects two branches (6*a*, 6*b*) of said main circuit (6), and a second operating position wherein saic connector (36) cuts off said main circuit (6) an<separates said two branches (6*a*, 6*b*) of the main circuit, said magnetic switch (7) also comprising an electromagnet (29) supplied by said activating circuit (8) and fog exerting, when said activating circuit (8) is closed, <predetermined electromagnetic attraction on an armaturE (42) carried integrally by said member (37); saic electromagnetic attraction ceasing when said activatine circuit (8) is cut off.

8. A device as claimed in claim 7, wherein said actuating means are elastic means (10) fog exerting a predetermined force on said member (37); said electromagnetic attraction only being greater than said predetermined force exerted by said elastic means (10) when the distance between said electromagnet (29) and said armature (42) is less than a predetermined minimum distance; said armature (42) being separated from said electromagnet (29) by a distance smaller than said minimum distance when said member (37) is in said first operating position; and said armature (42) being separated from said electromagnet (29) by a distance greater than said minimum distance when said member (37) is in said second operating position.

9. A device as claimed in claim 8, further comprising a seat (24) in which said member (37) slides, and which houses facing contacts (26, 27) connected respectively to said two branches (6*a*, 6*b*) of said main circuit (6); said elastic means (10) being interposed between a bottom wall (28) of said seat (24) and an axial shoulder (45) of said member (37).

10. A device as claimed in claim 9, wherein said member (37) has an opening (41) for the insertion of said connector (36); said connector (36) extending transversely trough said member (37) and inside said opening (41), and projecting from opposite sides of said opening (41) towards said contacts (26, 27).

11. An electric appliance (2), comprising a control device (1) the device comprising a main circuit (6); means (7, 9) for cutting off said main circuit (6); and a hinge (5) supporting a user-operated movable member (3) of said appliance; wherein said means for cutting off the main circuit comprise contact means (9) associated with said hinge (5) and for selectively opening and closing said main circuit (6) when said hinge (5) is rotated; said contact means (9) comprising a fixed contact (21) connected to said appliance, a movable contact (20) carried by a movable portion (5*a*) of said hinge (5), and insulating means (14; 22) for electrically insulating said fixed contact and said movable contact (21, 20) with respect to said appliance and said hinge (5).

12. A device for controlling an electric appliance, said device comprising:

a main circuit powering the appliance;

a hinge supporting a user-operated movable member of the appliance; and a pair of contacts associated with said hinge and selectively opening and closing said main circuit when said hinge is rotated, said contacts comprising a fixed contact connected to the appliance and a movable contact carried by a movable portion of said hinge.

13. A device as claimed in claim 12, wherein said movable member is a door of said appliance; and said movable contact is defined by a contoured metal plate carried by said movable portion of the hinge, said movable contact contacting said fixed contact when said door is closed and being detached from said fixed contact when said movable portion is rotated by opening said door.

14. A device as claimed in claim 13, wherein said fixed contact and said movable contact are electrically insulated from said appliance and said hinge, respectively, said device further comprising an insulating insert made of electrically insulating material and carried by said movable portion of the hinge, said metal plate extending from said insulating insert.

15. A device as claimed in claim 13, wherein said movable portion of the hinge has an electrically insulating outer surface, said movable portion being made of plastic insulating material or comprising a metal core coated with plastic insulating material.

16. A device as claimed in claim 13, wherein said movable portion of the hinge comprises a base portion having opposite first and second ends, the first end being rotatably supported by a casing of said appliance; and a curved arm projecting laterally from the second end of said base portion and curved towards said first end, said metal plate being carried by said base portion and projecting from said base portion on the opposite side to said curved arm.

17. A device as claimed in claim 12, further comprising a reactivatable magnetic switch which selectively assumes a closed position and an open position respectively closing and opening said main circuit; and an activating circuit electrically coupled to said magnetic switch for activating said magnetic switch, said fixed and moveable contacts being incorporated in said activating circuit to selectively close and open said activating circuit.

18. A device as claimed in claim 17, wherein said magnetic switch comprises an electric connector carried by a member movable between a first operating position where said connector electrically connects two branches of said main circuit, and a second operating position wherein said connector cuts off said main circuit and separates said two branches of the main circuit; and an electromagnet powered by said activating circuit, said magnet exerting, when said activating circuit is closed, a predetermined electromagnetic attraction on an armature carried by said member that carries the electric connector, said electromagnetic attraction ceasing when said activating circuit is cut off.

19. A device as claimed in claim 18, further comprising an elastic element exerting a predetermined force on said member to move said magnetic switch into the open position when said activating circuit is cut off and maintain said magnetic switch in the open position even when said activating circuit is again closed;

wherein said electromagnetic attraction is only greater than said predetermined force when the distance between said electromagnet and said armature is less than a predetermined minimum distance, said armature being separated from said electromagnet by a distance smaller than said minimum distance when said member is in said first operating position, and said armature being separated from said electromagnet by a distance greater than said minimum distance when said member is in said second operating position.

20. A device as claimed in claim 19, further comprising a seat in which said member slides, said seat housing contacts connected respectively to said two branches of said main circuit, said elastic element being interposed between a bottom wall of said seat and a shoulder of said member.

21. A device as claimed in claim 20, wherein said connector extends transversely through a wall of said member to project from opposite sides of said member towards said contacts that are connected said two branches of said main circuit.

* * * * *